US005964670A

United States Patent [19]

Cheng

[11] Patent Number: 5,964,670

[45] **Date of Patent: *Oct. 12, 1999**

[54] GOLF CLUB SHAFT HAVING IMPROVED FEEL

[75] Inventor: Michael H. L. Cheng, Simi Valley, Calif.

[73] Assignee: Harrison Sports, Inc., Pacoima, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,143

[22] Filed: Jan. 22, 1997

[51] Int. Cl.[6] ..... A63B 53/10

[52] U.S. Cl. ..... 473/319; 473/323

[58] Field of Search ..... 473/316–323, 473/520–521, 549, 568; 273/DIG. 7, DIG. 23

[56] References Cited

U.S. PATENT DOCUMENTS

| | | | |
|---|---|---|---|
| 1,232,816 | 7/1917 | Lard | 473/298 |
| 1,418,038 | 5/1922 | Tousey | 473/317 |
| 2,031,161 | 2/1936 | Hamel | 473/568 |
| 2,130,395 | 9/1938 | Lard . | |
| 2,150,737 | 3/1939 | Chittick | 473/315 |
| 2,153,880 | 4/1939 | Barnhart . | |
| 2,220,852 | 11/1940 | Scott . | |
| 3,083,969 | 4/1963 | Bills . | |
| 4,169,595 | 10/1979 | Kaugars . | |
| 4,205,845 | 6/1980 | Kanne . | |
| 4,288,075 | 9/1981 | Kaugars et al. . | |
| 4,319,750 | 3/1982 | Roy . | |
| 4,330,126 | 5/1982 | Rumble . | |
| 4,431,187 | 2/1984 | Rumble et al. . | |
| 4,455,022 | 6/1984 | Wright | 473/318 |
| 4,470,600 | 9/1984 | Parente et al. . | |
| 4,555,112 | 11/1985 | Masghati . | |
| 4,591,157 | 5/1986 | Parente et al. . | |
| 5,018,735 | 5/1991 | Meredith | 473/318 |
| 5,294,119 | 3/1994 | Vincent et al. . | |
| 5,316,299 | 5/1994 | Feche et al. . | |
| 5,362,046 | 11/1994 | Sims . | |
| 5,496,028 | 3/1996 | Chien | 273/DIG. 23 |
| 5,551,691 | 9/1996 | Harada | 473/318 |
| 5,599,242 | 2/1997 | Solviche | 473/318 |
| 5,634,860 | 6/1997 | McIntosh | 473/318 |
| 5,711,728 | 1/1998 | Marcelo | 473/520 |
| 5,716,291 | 2/1998 | Morell | 473/319 |
| 5,735,752 | 4/1998 | Antonious | 473/318 |

FOREIGN PATENT DOCUMENTS

| | | |
|---|---|---|
| 173914 | 7/1921 | United Kingdom . |

*Primary Examiner*—Jeanette Chapman
*Assistant Examiner*—Stephen L. Baul
*Attorney, Agent, or Firm*—Henricks, Slavin & Holmes LLP

[57] ABSTRACT

A golf club shaft including a tip section, a grip section, a main body section and a vibration control section. The vibration control section prevents first harmonic vibrations, second harmonic vibrations, third harmonic vibrations, and so on from be transmitted to the hands of the golfer after impact.

25 Claims, 5 Drawing Sheets

GOLF CLUB SHAFT HAVING IMPROVED FEEL

BACKGROUND OF THE INVENTION

1. Field of Invention

The present invention relates generally to golf clubs and, more particularly, to golf club shafts.

2. Description of the Related Art

Over the years, many substitutes have been introduced for the hard wood shafts originally used in golf club drivers and irons. Early substitute materials included steel and aluminum. More recently, carbon fiber reinforced resin shafts have become popular. Fiber reinforced resin shafts are typically hollow, round in cross-section and consists of the tip, main body, and grip sections. Such shafts typically have a constant taper from the tip/main body portion intersection to the main body portion/grip intersection. The surface of the shaft is typically smooth and continuous.

When a golfer strikes a golf ball, vibrations are transmitted through the shaft to the golfer's hands. These vibrations, which are commonly referred to as the club's "feel," provide experienced golfers with considerable information about their shots. In fact, many golfers can tell whether or not they have hit a good shot through feel alone. Golf clubs, like other vibrating bodies, typically have a fundamental mode of vibration, a first harmonic, a second harmonic, a third harmonic, and so on. The inventor herein has determined that the feel of a golf club is created by the fundamental mode of vibration. The first harmonic, second harmonic, third harmonic, and so on tend to create "noise" which detracts from the feel created by the fundamental mode.

SUMMARY OF THE INVENTION

Accordingly, the general object of the present invention is to provide a golf club shaft which eliminates, for practical purposes, the aforementioned problems. In particular, one object of the present invention is to provide a golf club shaft which transmits the fundamental mode vibrations to the hands of the golfer after impact, while preventing the first harmonic vibrations, second harmonic vibrations, third harmonic vibrations, and so on from reaching the golfers hands.

In order to accomplish these and other objectives, a golf club shaft in accordance with a preferred embodiment of the present invention includes a vibration control section that creates harmonic vibrations which substantially cancel the first harmonic vibrations, second harmonic vibrations, third harmonic vibrations, and so on. This enables the present invention to substantially eliminate the "noise" created by first harmonic, second harmonic, third harmonic, and so on. In other words, the present invention provides a "noise" filter which gives the golfer clearer feedback from his or her shot. The present invention also performs this function without substantially effecting the fundamental mode vibrations so that the feel of the club is preserved.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
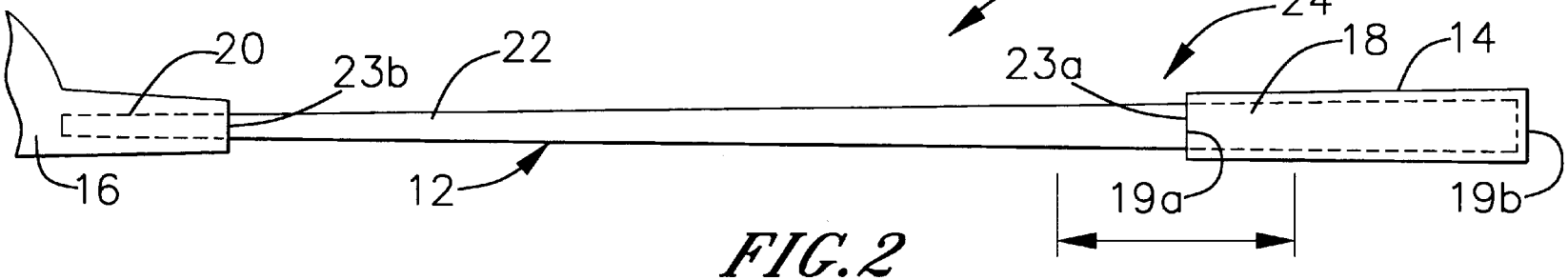
FIG. 1 is a side elevation view of a golf club in accordance with the present invention.

As illustrated for example in FIG. 1, a golf club 10 in accordance with a preferred embodiment of the present invention includes a shaft 12, a grip 14, and a club head 16. The exemplary shaft is divided into three sections—the grip section 18 (having a distal end 19*a* and a proximal end 19*b*) which is covered by the grip, the tip section 20 which supports the club head, and the main body section 22 (having a distal end 23*a* and a proximal end 23*b*) which extends from the distal end of the grip section to the proximal end of the tip section. The distal portion of the grip section 18 and the proximal portion of the main body section 22 form a vibration control section 24. The vibration control section 24 may also be thought of as a separate section which extends from a location within the grip 14 to a location outwardly thereof so as to connect a grip section to a main body section. The purpose of the vibration control section 24 is to mask certain modes of vibrations, preferably all modes but the fundamental mode of vibration. This masks the noise caused by the first harmonic, second harmonic, third harmonic and so on and results in a golf club which provides the user with superior feel. The masking is accomplished by creating multiple harmonic vibrations of the same frequency which cancel out the first harmonic, second harmonic, third harmonic and so on. As described in greater detail below, the vibration control section may take a variety of forms.

It should be noted that the dimensions of the shafts illustrated in the drawings are exaggerated, specifically highlighting the vibration control instrumentalities. Commercial embodiments of the shafts described below may range from 33 inches to 44 inches in overall length. With respect to the tip section 20, the length may range from about 3 inches to 7 inches and the outer diameter (OD) may range from about 0.370 inch to 0.395 inch for irons and about 0.335 inch for woods. The length of the grip section 18 may range from about 6 inches to about 10 inches. The exemplary grip section may be either substantially tubular with an OD of 0.58 inch to 0.62 inch or tapered from an OD of about 0.81 inch to 1.0 inch at the butt to an OD of about 0.55 inch to 0.70 inch.

Figure 2:
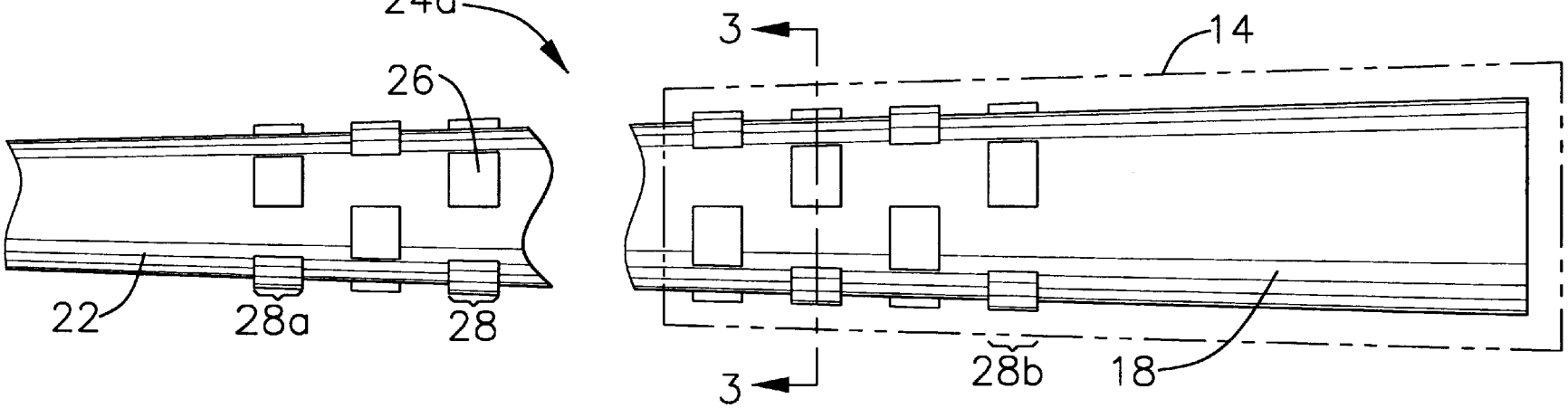
FIG. 2 is a partial side elevation view of a golf club shaft in accordance with one preferred embodiment of the present invention.
Figure 3:
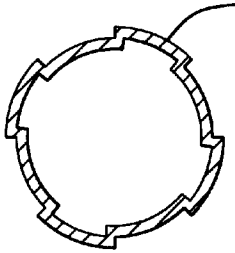
FIG. 3 is a section view taken along line 3—3 in FIG. 2.
Figure 4:
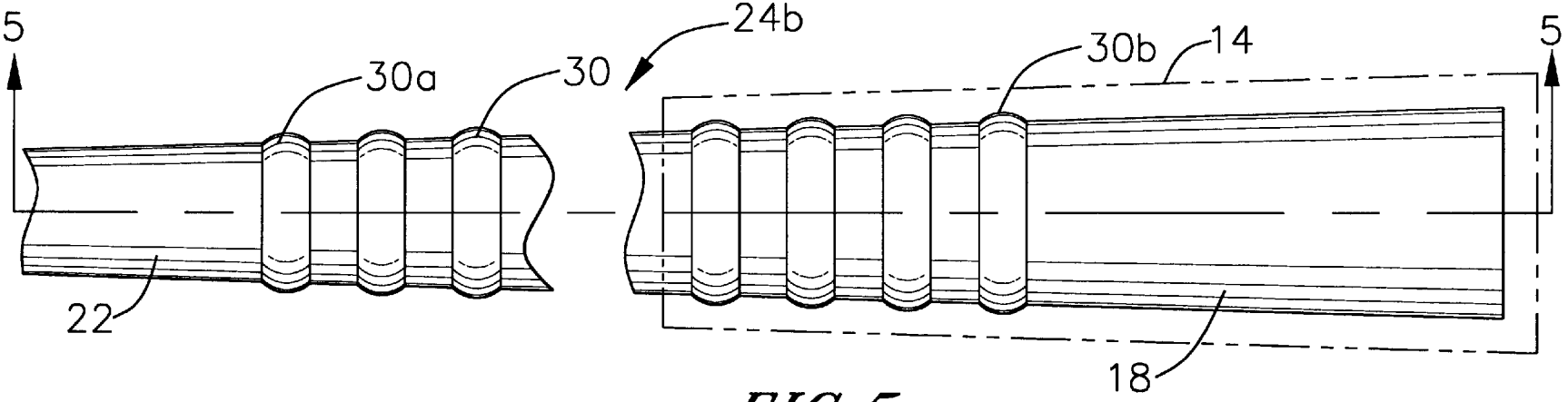
FIG. 4 is a partial side elevation view of a golf club shaft in accordance with another preferred embodiment of the present invention.
Figure 5:
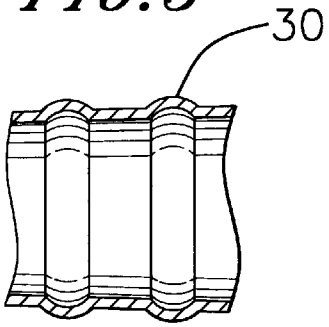
FIG. 5 is a partial section view taken along line 5—5 in FIG. 4.
Figure 6:
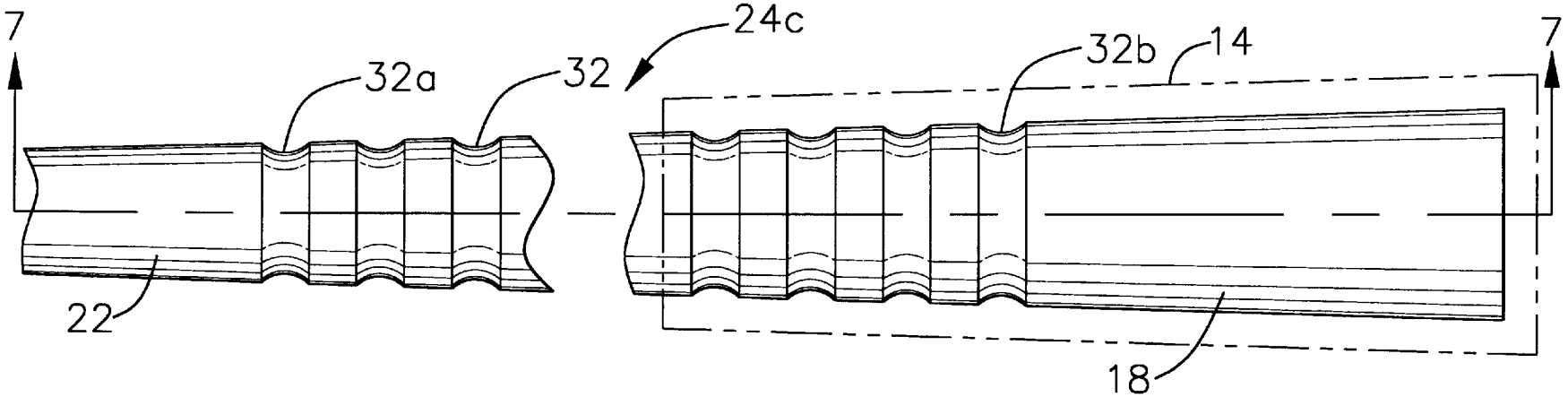
FIG. 6 is a partial side elevation view of a golf club shaft in accordance with another preferred embodiment of the present invention.
Figure 7:
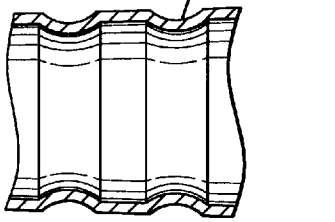
FIG. 7 is partial a section view taken along line 7—7 in FIG. 6

The exemplary vibration control section 24*a* illustrated in FIGS. 2 and 3 includes a plurality of surface protuberances 26 that are arranged in a series of longitudinally spaced groups 28. The protuberances in each group are circumferentially spaced and, as illustrated in FIG. 2, may be circumferentially offset from those in an adjacent group. Similarly, as shown by way of example in FIGS. 4 and 5, alternative protuberances 30 are in the form of rings which extend around the circumference of the shaft. The ring-shaped protuberances are longitudinally spaced to form a vibration control section 24*b*. Another exemplary vibration control section 24*c* is shown in FIGS. 6 and 7. Here, the vibration control section consists of a series of longitudinally spaced indentations 32. Although not illustrated, the indentations may also be circumferentially and longitudinally spaced in a manner similar to that shown in FIG. 2. Additionally, in each of the exemplary embodiments shown in FIGS. 2–7, the respective surfaces of the shafts are co-linear on opposite longitudinal sides of the protuberances and indentations (collectively "discontinuities"). In other words, the discontinuity-free portions of the shafts are shaped as they would have been if the discontinuities were not present.

Exemplary vibration control sections 24*a*, 24*b* and 24*c* each occupy respective portions of the shaft's grip section 18 and main body section 22. As a result, some of the protuberances 26 and 30 and indentations 32 will be covered by the grip 14 (shown in dashed lines) when the golf club is assembled. The exemplary protuberances 26 and 30 and indentation 32 are on the order of 0.50 inch in length (measured in the longitudinal direction of the shaft). Protuberances 26, which have a square shape, are also 0.50 inch in width. The height of the protuberances 26 and 30, i.e. the amount which the protuberances extend above the otherwise smooth, continuous surface of the shaft, is preferably between 0.5 mm and 4 mm. The depth of the indentations 32 is also preferably between 0.5 mm and 4 mm.

In the exemplary embodiments, the distal protuberance group 28*a* (FIG. 2), distal ring-shaped protuberance 30*a* (FIG. 4), and distal indentation 32*a* (FIG. 6) are each preferably approximately 4 inches from the end of the grip 14. The proximal group of protuberances 28*b* (FIG. 2), proximal ring-shaped protuberance 30*b* (FIG. 4), and proximal indentation 32*b* (FIG. 6) are each located approximately 3 inches into the grip section 18. With respect to longitudinal spacing, each protuberance group 28, ring-shaped protuberance 30 and indentation 32 may be approximately 0.25 inch to 0.75 inch from the adjacent protuberance group, ring-shaped protuberance or indentation. The preferred spacing is 0.5 inch.

Figure 8:
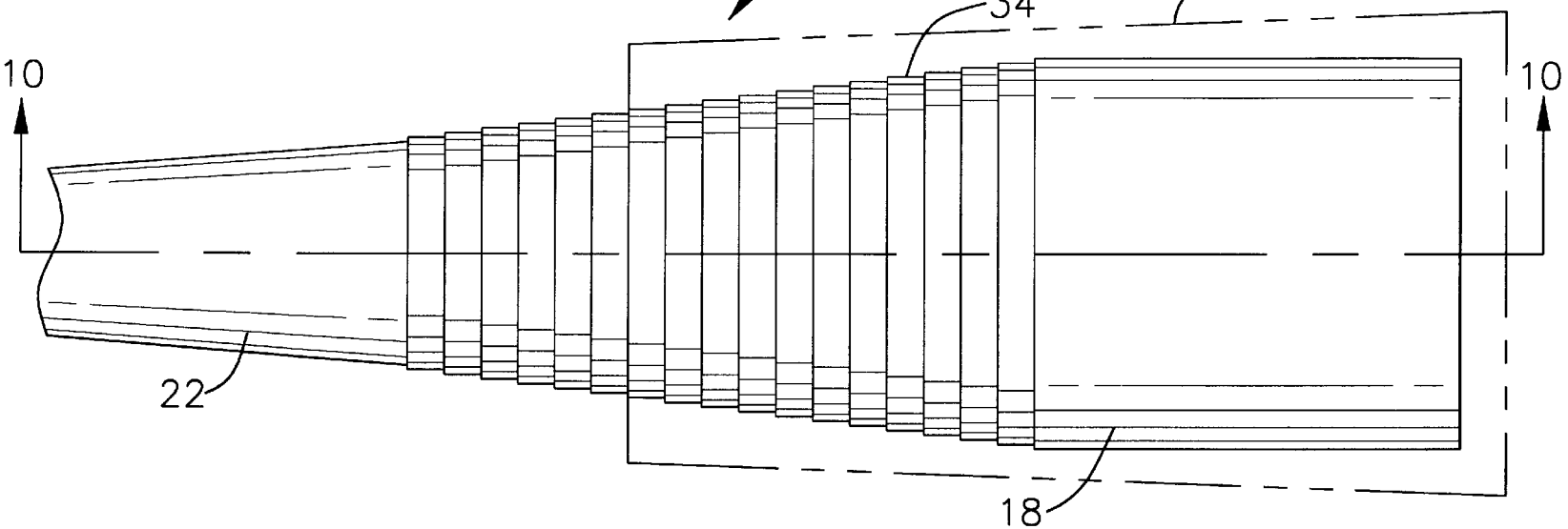
FIG. 8 is a partial side elevation view of a golf club shaft in accordance with another preferred embodiment of the present invention.

Turning to FIG. 8, another exemplary vibration control section 24*d* is formed by a series of steps 34. Viewed from the main body section 22 to the grip section 18, the OD of the shaft increases from step to step. This embodiment is especially useful with a standard diameter main body section that ranges in OD from 0.335 inch to 0.50 inch at the tip section to 0.52 inch to 0.64 inch at the first step 34. Alternatively, as shown by way of example in FIG. 9, a series of steps 36 form a vibration control section 24*e*. Here, the OD of the shaft decreases from step to step when viewed from the main body section 22 to the grip section 18. This embodiment is especially useful with a "wide body" shaft in which the OD of main body section tapers from 0.335 inch to 0.50 inch at the tip section up to 0.65 inch to 0.75 inch at the first step 36. The length of each step ranges from 0.25 inch to 0.75 inch and is preferably 0.5 inch. The steps may be between 1 mm and 4 mm in height and the sloped portion which extends from one step to another may be between 1 mm and 4 mm in the longitudinal direction.

Figure 9:
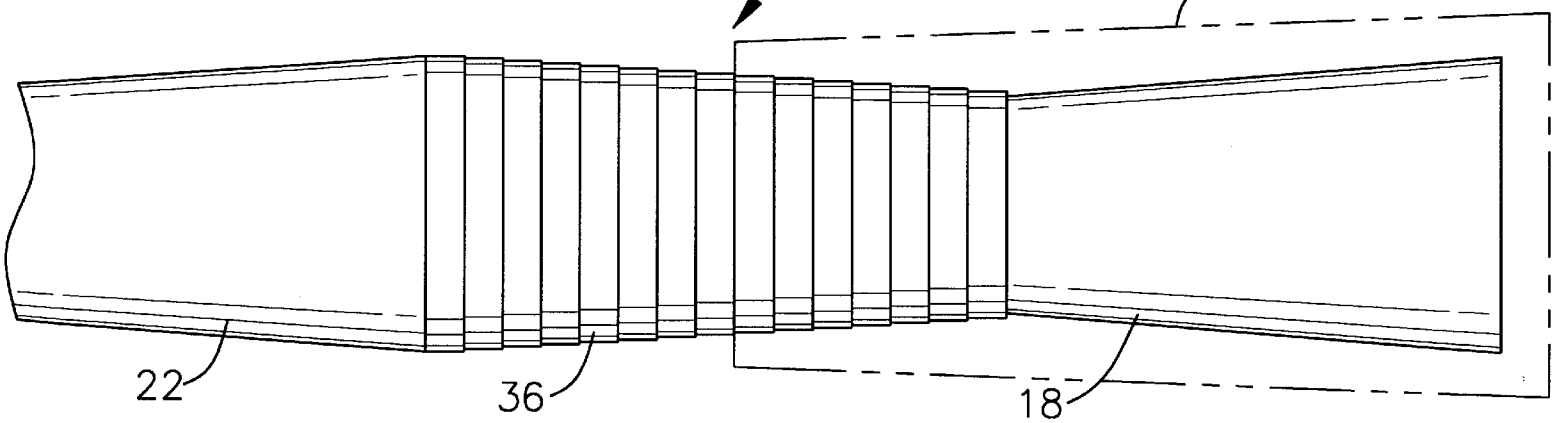
FIG. 9 is a partial side elevation view of a golf club shaft in accordance with another preferred embodiment of the present invention.

The shaft shown in FIG. 8 may be modified by employing a grip section which tapers inwardly from the butt end to the main body section, such as that shown in FIG. 9, in place of the generally tubular grip section. Similarly, a generally tubular grip section may be employed in the embodiment shown in FIG. 9. A tubular section may also be added to the tapered main body section such that the tubular section separates the steps from the tapered main body section.

Figure 10A:
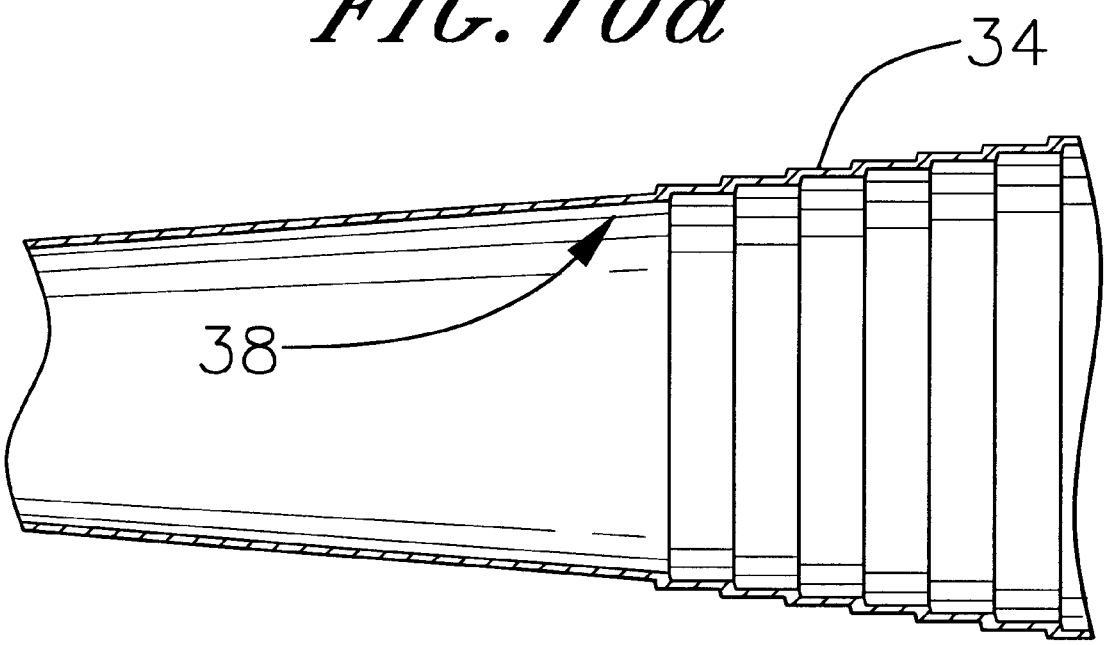
FIGS. 10*a* and 10*b* are alternate partial section views taken along line 10—10 in FIG. 8.
Figure 10B:
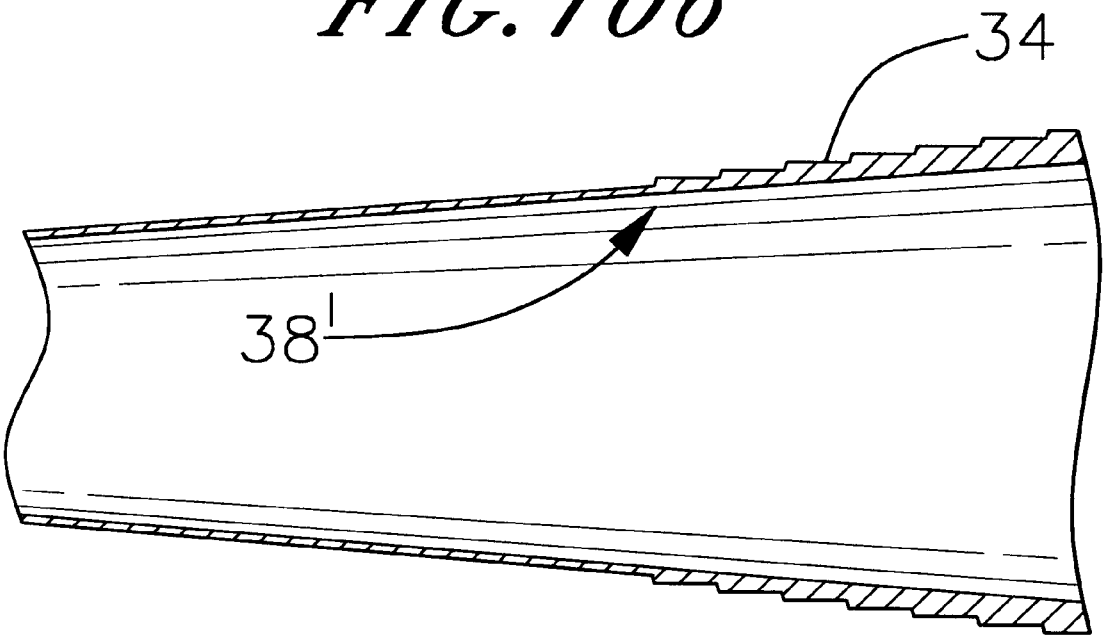

As illustrated in FIG. 10*a*, the steps may be formed by varying the diameter of the inner surface 38 of the shaft, while keeping the wall thickness of the shaft substantially uniform. Alternatively, as shown in FIG. 10*b*, the inner surface 38' may have a constant taper, while the thickness of the shaft wall is varied to create the steps.

Turning to manufacturing, the present shafts may be manufactured through a bladder molding process wherein multiple layers (typically 10–20 layers) of a fiber reinforced resin composite are wrapped around a bladder. A mold having the desired shape is placed around the wrapped bladder. The bladder is then inflated, thereby forcing the resin material against the mold. Alternatively, the shaft wall may be formed by wrapping multiple layers (typically 10–20 layers) of a fiber reinforced resin composite over a mandrel until the desired thickness is obtained. The fibers of each successive layer are preferably oriented at different angles with respect to the longitudinal axis of the shaft. The fibers of some layers may be parallel to the longitudinal axis, while the fibers of other layers are angled from 30–90 degrees with respect to the longitudinal axis. It should be noted, however, that the fibers of successive base rod layers, such as the outer layers, may be parallel to one another. Other layer combinations are also possible. For example, the first 5 to 10 layers may be alternating angled layers, and the next 5 to 10 layers may be parallel to the longitudinal axis.

The present invention may be practiced with any of the materials typically used to produce composite resin/fiber golf club shafts. Suitable resins include, for example, thermosetting resins or polymers such as polyesters, epoxies, phenolics, melamines, silicones, polimides, polyurethanes and thermoplastics. Suitable fibers include, for example, carbon-based fibers such as graphite, glass fibers, aramid fibers, and extended chain polyethylene fibers. After the successive layers of fiber reinforced resin are wrapped around the mandrel, the shaft is cured in an oven. Curing times and temperatures depend on the polymer used in the composite and are well known to those of skill in the art.

Although the present invention has been described in terms of the preferred embodiment above, numerous modifications and/or additions to the above-described preferred embodiments would be readily apparent to one skilled in the art. By way of example, but not limitation, the quantity, size, shape, spacing and location of the protuberances, indentations and steps may, of course, be varied in order to obtain the desired vibration controlling effect. It is intended that the scope of the present invention extends to all such modifications and/or additions and that the scope of the present invention is limited solely by the claims set forth below.

I claim:

1. A golf club shaft, comprising:

a hollow grip section defining a proximal end, a distal end, an inner surface and an outer surface, both extending from the proximal end to the distal end, the inner and outer surfaces of the grip section including at least one grip section surface discontinuity located between the distal end and a location in spaced relation to the proximal end, the at least one grip section surface discontinuity defining longitudinally spaced ends, and portions of the surface of the grip section adjacent opposite ends of the at least one grip section surface discontinuity being substantially co-linear;

a tip section; and a hollow main body section extending from the grip section to the tip section and defining a proximal end, a distal end, an inner surface and an outer surface, both extending from the proximal end to the distal end, the inner and outer surfaces of the main body section including at least one main body section surface discontinuity located between the proximal end and a location in spaced relation to the distal end, the at least one main body section surface discontinuity defining longitudinally spaced ends, and portions of the surface of the main body section adjacent opposite ends of the at least one main body discontinuity being substantially co-linear;

wherein at least one of the discontinuities defines an outer perimeter and at least a portion thereof within the outer perimeter is free of holes and wherein at least one of the grip section surface discontinuity and the main body section surface discontinuity comprises a plurality of discontinuities.

2. A golf club shaft as, comprising:

a hollow grip section defining a proximal end, a distal end, an inner surface and an outer surface, both extending from the proximal end to the distal end, the inner and outer surfaces of the grip section including at least one grip section surface discontinuity located between the distal end and a location in spaced relation to the proximal end, the at least one grip section surface discontinuity defining longitudinally spaced ends, and portions of the surface of the grip section adjacent opposite ends of the at least one grip section surface discontinuity being substantially co-linear;

a tip section; and a hollow main body section extending from the grip section to the tip section and defining a proximal end, a distal end, an inner surface and an outer surface, both extending from the proximal end to the distal end, the inner and outer surfaces of the main body section including at least one main body section surface discontinuity located between the proximal end and a location in spaced relation to the distal end, the at least one main body section surface discontinuity defining longitudinally spaced ends, and portions of the surface of the main body section adjacent opposite ends of the at least one main body discontinuity being substantially co-linear;

wherein at least one of the grip section surface discontinuity and the main body section surface discontinuity comprises a plurality of surface protuberances.

3. A golf club shaft as claimed in claim 2, wherein the plurality of surface protuberances comprises a plurality of longitudinally spaced rings.

4. A golf club shaft, comprising:

a grip section defining a proximal end, a distal end and a surface extending from the proximal end to the distal end, the surface of the grip section including at least one grip section surface discontinuity located between the distal end and a location in spaced relation to the proximal end, the at least one grip section surface discontinuity defining longitudinally spaced ends, and portions of the surface of the grip section adjacent opposite ends of the at least one grip section surface discontinuity being substantially co-linear;

a tip section; and a main body section extending from the grip section to the tip section and defining a proximal end, a distal end and a surface extending from the proximal end to the distal end, the surface of the main body section including at least one main body section surface discontinuity located between the proximal end and a location in spaced relation to the distal end, the at least one main body section surface discontinuity defining longitudinally spaced ends, and portions of the surface of the main body section adjacent opposite ends of the at least one main body discontinuity being substantially co-linear;

wherein at least one of the grip section surface discontinuity and the main body section surface discontinuity comprises a plurality of surface protuberances and the plurality of surface protuberances comprises a plurality of longitudinally spaced surface protuberance groups, each group including a plurality of circumferentially spaced surface protuberances.

5. A golf club shaft as claimed in claim 4, wherein the surface protuberances in one surface protuberance group are circumferentially offset from the surface protuberances in a longitudinally adjacent surface protuberance group.

6. A golf club shaft, comprising:

a grip section defining a proximal end, a distal end and a surface extending from the proximal end to the distal end, the surface of the grip section including at least one grip section surface discontinuity located between the distal end and a location in spaced relation to the proximal end, the at least one grip section surface discontinuity defining longitudinally spaced ends, and portions of the surface of the grip section adjacent opposite ends of the at least one grip section surface discontinuity being substantially co-linear:

a tip section; and a main body section extending from the grip section to the tip section and defining a proximal end, a distal end and a surface extending from the proximal end to the distal end, the surface of the main body section including at least one main body section surface discontinuity located between the proximal end and a location in spaced relation to the distal end, the at least one main body section surface discontinuity defining longitudinally spaced ends, and portions of the surface of the main body section adjacent opposite ends of the at least one main body discontinuity being substantially co-linear;

wherein at least one of the grip section surface discontinuity and the main body section surface discontinuity comprises a plurality of surface protuberances and the surface protuberances define substantially rectangular shapes in plan.

7. A golf club shaft, comprising:

a hollow grip section defining a proximal end, a distal end, an inner surface and an outer surface, both extending from the proximal end to the distal end, the inner and outer surfaces of the grip section including at least one grip section surface discontinuity located between the distal end and a location in spaced relation to the proximal end, the at least one grip section surface discontinuity defining longitudinally spaced ends, and portions of the surface of the grip section adjacent opposite ends of the at least one grip section surface discontinuity being substantially co-linear;

a tip section; and a hollow main body section extending from the grip section to the tip section and defining a proximal end, a distal end, an inner surface and an outer surface, both extending from the proximal end to the distal end, the inner and outer surfaces of the main body section including at least one main body section surface discontinuity located between the proximal end and a location in spaced relation to the distal end, the at least one main body section surface discontinuity defining longitudinally spaced ends, and portions of the surface of the main body section adjacent opposite ends of the at least one main body discontinuity being substantially co-linear;

wherein at least one of the discontinuities defines an outer perimeter and at least a portion thereof within the outer perimeter is free of holes and wherein at least one of the grip section surface discontinuity and the main body section surface discontinuity comprises a plurality of surface indentations.

8. A golf club shaft as claimed in claim 7, wherein the plurality of surface indentations comprises a plurality of longitudinally spaced rings.

9. A golf apparatus, comprising:

a golf club shaft including a grip section defining a proximal end, a distal end and a surface extending from the proximal end to the distal end, the surface of the grip section including at least one grip section surface protuberance integrally formed with the golf club shaft and located between the distal end and a location in spaced relation to the proximal end;

a tip section; and a main body section extending from the grip section to the tip section and defining a proximal end, a distal end and a surface extending from the proximal end to the distal end, the surface of the main body section including at least one main body section surface protuberance integrally formed with the golf club shaft and located between the proximal end and a location in spaced relation to the distal end; and a grip located over the grip section and covering the at least one grip section surface protuberance.

10. A golf club shaft as claimed in claim 9, wherein at least one of the grip section surface protuberance and the main body section surface protuberance comprises a plurality of surface protuberances.

11. A golf club shaft as claimed in claim 10, wherein the plurality of surface protuberances comprises a plurality of longitudinally spaced rings.

12. A golf club shaft, comprising:

a hollow grip section defining a proximal end, a distal end, an inner surface and an outer surface, both extending from the proximal end to the distal end, the inner and outer surfaces of the grip section including at least one grip section surface indentation located between the distal end and a location in spaced relation to the proximal end, the at least one grip section surface indentation defining an outer perimeter and at least a portion of the at least one grip section surface indentation within the outer perimeter being free of holes;

a tip section; and a hollow main body section extending from the grip section to the tip section and defining a proximal end, a distal end, an inner surface and an outer surface, both extending from the proximal end to the distal end, the inner and outer surfaces of the main body section including at least one main body section surface indentation located between the proximal end and a location in spaced relation to the distal end, the at least one main body section surface indentation defining an outer perimeter and at least a portion of the at least one main body section surface indentation within the outer perimeter being free of holes;

wherein at least one of the grip section surface indentation and the main body section surface indentation comprises a plurality of surface indentations.

13. A golf club shaft as claimed in claim 9, wherein the at least one grip section surface protuberance is located substantially adjacent to the grip section distal end, and the at least one main body section surface discontinuity is located substantially adjacent to the main body section proximal end.

14. A golf club shaft, comprising:

a grip section defining a proximal end, a distal end and a surface extending from the proximal end to the distal end, the surface of the grip section including at least one grip section surface protuberance located between the distal end and a location in spaced relation to the proximal end;

a tip section; and a main body section extending from the grip section to the tip section and defining a proximal end, a distal end and a surface extending from the proximal end to the distal end, the surface of the main body section including at least one main body section surface protuberance located between the proximal end and a location in spaced relation to the distal end;

wherein at least one of the grip section surface protuberance and the main body section surface protuberance comprises a plurality of surface protuberances and the plurality of surface protuberances comprises a plurality of longitudinally spaced surface protuberance groups, each group including a plurality of circumferentially spaced surface protuberances.

15. A golf club shaft as claimed in claim 14, wherein the surface protuberances in one surface protuberance group are circumferentially offset from the surface protuberances in a longitudinally adjacent surface protuberance group.

16. A golf club shaft, comprising:

a grip section defining a proximal end, a distal end and a surface extending from the proximal end to the distal end, the surface of the grip section including at least one grip section surface protuberance located between the distal end and a location in spaced relation to the proximal end;

a tip section; and a main body section extending from the grip section to the tip section and defining a proximal end, a distal end and a surface extending from the proximal end to the distal end, the surface of the main body section including at least one main body section surface protuberance located between the proximal end and a location in spaced relation to the distal end;

wherein at least one of the grip section surface protuberance and the main body section surface protuberance comprises a plurality of surface protuberances and the surface protuberances define substantially rectangular shapes in plan.

17. A golf club shaft as claimed in claim 9, wherein the shaft defines an outer surface, and the main body section surface and the grip section surface comprise respective portions of the outer surface of the shaft.

18. A golf club shaft as claimed in claim 17, wherein the plurality of surface indentations comprises a plurality of longitudinally spaced rings.

19. A golf club shaft as claimed in claim 17, wherein the shaft defines an outer surface, and the main body section surface and the grip section surface comprise respective portions of the outer surface of the shaft.

20. A golf club shaft, comprising:

a grip section defining a proximal end and a distal end;

a tip section;

a main body section defining a proximal end abutting the distal end of the grip section and a distal end abutting the tip section; and a plurality of longitudinally spaced surface protuberance groups, each group including a plurality of circumferentially spaced surface protuberances, the protuberances being integral with the grip section and main body section, and extending from a location within the grip section in spaced relation to the grip section proximal end to a location within the main body section in spaced relation to the main body section distal end, for masking predetermined harmonics associated with impact generated vibrations.

21. A golf club shaft, comprising:

a grip section defining a proximal end, a distal end, an inner surface and an outer surface, both extending from the proximal end to the distal end;

a tip section; and a main body section extending from the grip section to the tip section and defining a proximal end, a distal end, an inner surface and an outer surface, both extending from the proximal end to the distal end;

wherein at least one of the grip section and the main body section includes an inner and outer surface discontinuity defining longitudinally spaced ends, and portions of the surface of the at least one of the grip section and the main body section adjacent opposite ends of the at least one inner and outer surface discontinuity are substantially co-linear and the at least one inner and outer surface discontinuity comprises a plurality of surface protuberances.

22. A golf club shaft, comprising:

a grip section defining a proximal end, a distal end and a surface extending from the proximal end to the distal end;

a tip section; and a main body section extending from the grip section to the tip section and defining a proximal end, a distal end and a surface extending from the proximal end to the distal end;

wherein at least one of the grip section and the main body section includes a surface discontinuity defining longitudinally spaced ends, and portions of the surface of the at least one of the grip section and the main body section adjacent opposite ends of the at least one surface discontinuity are substantially co-linear and wherein the at least one surface discontinuity comprises a plurality of longitudinally spaced surface protuberance groups, each group including a plurality of circumferentially spaced surface protuberances.

23. A golf club shaft, comprising:

a grip section defining a proximal end, a distal end, an inner surface and an outer surface, both extending from the proximal end to the distal end;

a tip section; and a main body section extending from the grip section to the tip section and defining a proximal end, a distal end, an inner surface and an outer surface, both extending from the proximal end to the distal end;

wherein at least one of the grip section and the main body section includes an inner and outer surface discontinuity defining longitudinally spaced ends, and portions of the surface of the at least one of the grip section and the main body section adjacent opposite ends of the at least one inner and outer surface discontinuity are substantially co-linear and the at least one inner and outer surface discontinuity comprises a plurality of longitudinally spaced substantially ring-shaped surface protuberances.

24. A golf club shaft, comprising:

a hollow grip section defining a proximal end, a distal end, an inner surface and an outer surface, both extending from the proximal end to the distal end;

a tip section; and a hollow main body section extending from the grip section to the tip section and defining a proximal end, a distal end, an inner surface and an outer surface, both extending from the proximal end to the distal end;

wherein the inner and outer surfaces of the main body section and the grip section include a plurality of inner surface rings and a plurality of outer surface rings, respectively, the inner and outer surface discontinuities define respective outer perimeters, and at least a portion of each discontinuity within the outer perimeter thereof is free of holes.

25. A golf club shaft as claimed in claim 24, wherein the plurality of inner surface rings are spaced from one another and the plurality of outer surface rings are spaced from one another.

* * * * *